US006371566B1

(12) United States Patent
Haehn

(10) Patent No.: US 6,371,566 B1
(45) Date of Patent: Apr. 16, 2002

(54) PROCESS AND DEVICE FOR MILLING OFF TRAFFIC AREAS

(75) Inventor: Guenter Haehn, Koenigswinter (DE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 09/367,042

(22) PCT Filed: Oct. 31, 1998

(86) PCT No.: PCT/EP98/06899

§ 371 Date: Aug. 6, 1999

§ 102(e) Date: Aug. 6, 1999

(87) PCT Pub. No.: WO99/32726

PCT Pub. Date: Jul. 1, 1999

(30) Foreign Application Priority Data

Dec. 19, 1997 (DE) ..... 197 56 676

(51) Int. Cl.[7] ..... E01C 23/08
(52) U.S. Cl. ..... 299/1.5; 404/84.05
(58) Field of Search ..... 299/1.4, 1.5, 30; 404/84.05, 84.5

(56) References Cited

U.S. PATENT DOCUMENTS 3,414,327 A * 12/1968 Austin ..... 299/1.5
3,810,676 A * 5/1974 Clarke ..... 299/1.5
4,140,420 A * 2/1979 Swisher, Jr. et al. ..... 404/84.1
4,213,719 A * 7/1980 Swisher, Jr. et al. ..... 404/84.2
4,270,801 A * 6/1981 Swisher, Jr. et al. ..... 299/1.5
4,473,319 A * 9/1984 Spangler ..... 404/72
4,685,806 A * 8/1987 Arnberg ..... 356/376
5,533,790 A * 7/1996 Weiland ..... 299/1.5
5,607,205 A * 3/1997 Burdick et al. ..... 299/1.5

FOREIGN PATENT DOCUMENTS

WO 0547378 * 11/1992
WO 9516228 * 6/1995

* cited by examiner

*Primary Examiner*—David Bagnell
*Assistant Examiner*—Sunil Singh
(74) *Attorney, Agent, or Firm*—Diller, Ramik & Wight

(57) ABSTRACT

A process of milling by first surveying the actual profile of a traffic area and generating actual profile data. The desired profile data is generated from an initial basic data set and the desired profile data of the traffic area is corrected with respect to longitudinal waviness. The current position of the milling machine is determined and the milling depth is adjusted as an actual value. The milling depth is thereafter controlled as a function of the difference between the actual value and the desired value, including data of a traffic area whose length exceeds that of the longest longitudinal wave of the traffic area which is leveled or milled.

24 Claims, 3 Drawing Sheets

PROCESS AND DEVICE FOR MILLING OFF TRAFFIC AREAS

BACKGROUND OF THE INVENTION

The invention relates to a process for milling off traffic areas with a milling roller, a milling machine or a device for milling off traffic areas.

Such milling machines are required to first remove the old pavement of a traffic area prior to application of a new pavement.

Various systems are employed for automatic control of the milling depth of the milling roller used for road milling work. Common to all systems is that a constant desired value of the milling depth is determined once and this value remains unchanged until a new desired value is manually set. This desired value is thus independent of the position of the milling machine so that unevennesses in certain sections of the traffic area cannot be levelled out. Milling-off of an existing surface at a constantly set milling depth of the milling rollers results in copy-milling since the profile of the old surface reduced by the permanently adjusted milling depth is displayed on the new surface. To prevent such copying effect the actual milling depth (actual value) is measured via a sensor in various ways and compared with the desired milling depth (desired value) by a milling depth controller. This comparison is effected continuously and the determined desired value deviation is transferred into a control signal in the milling depth controller for height adjustment of the milling roller.

The following processes for measuring the actual value of the milling depth are applied in milling machines:

1. Height tracing with any sensor at the edge guard

Here a sensor measures the change in the distance between the edge guard of the milling machine tracing the road profile and a fixed point on the machine frame. The change in distance is the measure by which the edge guard is raised or lowered as it follows the road profile so that the milling depth can be automatically increased or decreased by this amount. The length of the edge guard is referred to here as tracing basis. Longitudinal waves with a wave length smaller than the edge guard length (approximately 1 to 2 m) are levelled out. Nevertheless copy-milling of the original actual profile is still effected since the edge guard runs on the existing profile and unevennesses of a larger wave length are copied into the new road profile.

2. Height tracing with a ski or measuring wheels mounted to a measuring rod

During this process a measuring ski or measuring wheel skis or rolls over the road surface. The ski or the wheel is vertically movable via a pivoted lever mounted to an angle of rotation transmitter which measures the change in the distance between measuring wheel or ski and the fixing point of the angle of rotation transmitter on the machine frame. The milling depth is then increased or reduced by the amount measured. The length of the ski or the measuring rod forms the tracing basis. Longitudinal unevennesses with a wave length exceeding the length of the ski or the measuring rod are copied, smaller longitudinal waves can be levelled out. Longitudinal waves with a wave length in the range from 5 to 10 m can be levelled out by extending the measuring rod or the ski.

3. Multiplex height tracing with a plurality of series-connected ultrasonic sensors In this process known from EP-A-0 547 378 three ultrasonic sensors are permanently mounted in longitudinal direction of the machine on one machine side, i.e. one sensor at the front machine end, one sensor above the rotational axis of the milling roller and one sensor at the rear machine end. The sensors measure the change in distance between the machine frame and the road profile. From these measured values and in consideration of the longitudinal inclination of the machine contained in the values measured by the front and rear sensors, a mean value is calculated by which the milling depth is increased or reduced. Owing to this measure the tracing basis increases to the length of the milling machine, which allows longitudinal waves with a wave length smaller than the machine length to be levelled out. This procedure, too, improves the evenness of the road profile, however, copy-milling still takes place with long-wave unevennesses with a wave length of more than 5 to 10 m continuing to be transferred to the new profile.

4. Tracing of the height relative to an additionally created reference

4a. During this process a levelling wire is stretched along the surface to be milled, and positioned by a measuring and adjusting process. The basis for correct location by a measuring process is the previous survey of the existing surface profile. The wire is continuously traced by a distance measuring means (angle of rotation transmitter, Sonic-ski etc.) permanently arranged on the machine frame with the changes in the distance between the machine frame and the wire being a measure for the milling depth correction of the milling roller. When this procedure is applied, it is no longer the unevenness of the original road surface which is copied into the new surface but a surface parallel to the levelling wire. A guiding wire correctly located by said measuring and adjusting process theoretically allows obtaining of the desired new road profile.

When the height is traced on a levelling wire, there is the problem that the levelling wire must be stretched and located by said measuring and adjusting process in accordance with the previously determined desired profile. This is very time-consuming and disadvantageous due to the costs involved.

4b. Levelling using a laser

This procedure is based on the beam of a stationary rotational laser setting an artificial disk-shaped plane. A laser receiver which is permanently mounted to the machine frame continuously measures the change in distance between the machine frame and the artificially set plane. Here, too, survey of the road profile must previously take place. This process theoretically allows a plane surface and, if necessary, an inclined surface to be produced, however, it is not possible to create any profile desired since the rotational laser always produces a disk-shaped plane.

Accordingly, the possible applications of the laser are limited. Furthermore, the laser must be accurately positioned and adjusted, which is time-consuming and expensive. Another disadvantage is that the measuring accuracy is not as high as that achieved with a mechanical sensor.

To sum up it can be said that during tracing of the height relative to the ground it is only possible to copy the existing road profile with the existing longitudinal unevennesses being inevitably taken over. Although extension of the tracing basis allows levelling out of these longitudinal waves up to a certain extent but wave lengths of more than 5 to 10 m cannot be levelled out. Especially these long-wave unevennesses lead to rocking motions of vehicles at a certain driving speed. This reduces both driving comfort and safety. Further disadvantages of longitudinal unevennesses of the road are a higher noise level and increased fuel consumption.

SUMMARY OF THE INVENTION

It is the object of the invention to provide a process and a device for milling off traffic areas allowing levelling out of the longitudinal waviness of a traffic area in a simple way.

According to the process of the invention the following steps are provided:

surveying the actual profile of the traffic area and generating at least two-dimensional actual profile data (x, z) by assigning the measured profile values to the position data of a relative or absolute position determining means, generating desired profile data from previously or on-line determined actual profile data with the desired profile data being corrected with regard to the longitudinal waviness of the traffic area, and determining the current position of the milling machine and the adjusted milling depth as actual value, controlling the milling depth of the milling roller, via a machine control unit, as a function of the difference between the actual value and the desired value from the desired profile data, the desired value being assigned to the current position of the milling machine.

The actual profile of the traffic area can be measured on line with the aid of a profile tracing means with the measured actual profile data being assigned to corresponding position data of a relative or absolute position determining means. The desired profile data are transferred by data carriers or by radio to the machine control unit unless they are calculated by a computer installed on the milling machine.

The height coordinate z is determined on the basis of the position data of the relative or absolute position determining means related to the profile tracting means or the milling machine. This z-coordinate is then additionally defined more precisely with the aid of a depth measuring means arranged on both the profile tracing means and the milling machine. The z-coordinate value of the actual profile data supplies an accurate position value in the space for the actual profile data. The z-coordinates may be combined with the absolute or relative position data in the plane (x, y-coordinates) or with distance information on the distance covered relatively to a reference point.

An important advantage presented by the process of the invention is thus that complicated position determination with regard to the milling machine is not necessary if assignment of the desired profile data, e.g. via distance information, is possible.

The least complicated way to determine the position is the relative determination of both machine position in the direction of path and height coordinate. For carrying out the process of the invention an accurate path measurement is thus sufficient when the desired profile data include distance information.

With regard to control of the milling depth the actual value of the adjusted milling depth constitutes the disturbance variable, the desired value from the desired profile data the reference variable and the adjusting signal for the milling depth of the milling roller the controlled variable.

Concerning the actual profile data, previous data which have been filed may be reverted to.

The desired profile data may contain position vectors to control the milling machine, i. e. the position of the milling machine in the plane (x, y, z or x, z-coordinates), the milling depth corrected in terms of longitudinal waviness (z-coordinate), the inclination and the travelling direction of the milling machine.

Finally the steering and/or the transverse inclination of the milling machine can be controlled as a function of the desired profile data and the current position data via the machine control unit.

The actual profile data determined from measurement of the actual profile using a profile tracing means contain in particular the longitudinal waviness of the traffic area. Insofar a specific base length of the profile tracing means is not required since the waviness included in the profile data is compensated for when the desired profile data are generated.

Prefereably the actual profile is measured again after processing the traffic area and the actual profile data with the assigned position data are stored for documentation purposes. With the aid of this documentation it can be proved to the contractor how accurately the desired profile of the traffic area has been adhered to.

The position of the profile tracing means and/or the milling machine can be determined in the space three-dimensionally in absolute or relative terms.

Alternatively the machine position in the plane can be determined in absolute terms and the height coordinate in relative terms.

In addition to the milling depth control the steering control of the milling machine can occur on the basis of the three-dimensional machine coordinates. Via such a machine control unit the milling machine could be remotely operated at site without intervention of the operating personnel.

Further development of the process is realized by the following steps:

surveying the actual profile by crossing a first section of the traffic area, generating the desired profile data from an initial basic data set containing the actual profile data of the first section of the traffic area, milling off the first section of the traffic area using a milling depth control on the basis of the desired profile data of the first section resulting from the initial basic data set, continuously updating the basic data set relating to a pre-determined basic length of the traffic area after milling off the first section in accordance with the progress of work by incrementally updating the actual profile data, and milling off further sections of the traffic area as a function of continuously updated desired profile data on the basis of the continuously updated basic data set.

At the beginning the actual profile in a first section of the traffic area is surveyed. This section serves as basic length for the actual profile data obtained which are stored in the initial basic data set. The actual profile data included in the initial basic data set serve for generation of the desired profile data for the first section. Subsequently the first section is subjected to milling off with the milling depth control being effected as a function of the position-dependent desired value of the desired profile data relating to the first section.

After milling off the first section the actual profile is continued to be continuously traced beyond the first section with the basic data set being permanently updated by the newly collected actual profile data. In this connection the basic data set relates to a predetermined basic length of the traffic area. This basic length follows the progress of work so that, in accordance with the collection of new actual profile data, the oldest actual profile data are removed from the basic data set. Milling-off of further sections of the traffic area is then effected as a function of continuously updated desired profile data on the basis of the continuously updated basic data set.

Preferably the length of the first section of the traffic area corresponds to the basic length of the continuously updated basic data set.

The basic data set contains the actual profile data of a section of the traffic area whose length exceeds the size of the largest longitudinal wave of the traffic area to be levelled out.

In the practice this means that the basic data set contains, for example, the actual profile data of a section of the traffic area of a length of approximately 50 to 300 m, preferably a length of approximately 100 to 200 m.

Surveying of the actual profile of the traffic area in the first section can advantageously be effected by the milling machine. Here the milling roller does not engage in the traffic area. At the front machine frame of the milling machine a profile tracing means and a position determining means are arranged.

Alternatively, surveying of the actual profile of the traffic area in the first section may be effected with a separately movable profile tracing means.

Following the first section the continuous surveying of the actual profile of the traffic area is performed with the aid of a profile tracing means arranged in the front area of the milling machine.

The basic length of the traffic area covered by the basic data set and used for generating the desired profile data may be variable as work progresses. In this way the special features of the topographical structure can be taken into account during the milling process.

The separate profile tracing means can trace the actual profile in front of the milling machine at a preselectable distance to the milling machine. The continuously generated desired profile data are produced from a basic data set which relates partly to a section of the traffic area located ahead relatively to the milling machine and partly to a section already crossed by the milling machine. In this case it is thus necessary that a separate profile tracing means always drives ahead relatively to the milling machine. This process offers the advantage that the basic length to which the basic data set relates always allows for a section of the traffic area lying ahead, while during on-line actual profile data collection on the milling machine the basic length is essentially related to a section of the traffic area lying aback, i.e. which has already been crossed by the milling machine.

BRIEF DESCRIPTION OF THE DRAWINGS

Hereunder embodiments of the invention are explained in detail with reference to the drawings in which.

DESCRIPTION OF THE PREFERRED EMBODIMENTS

Figure 1:
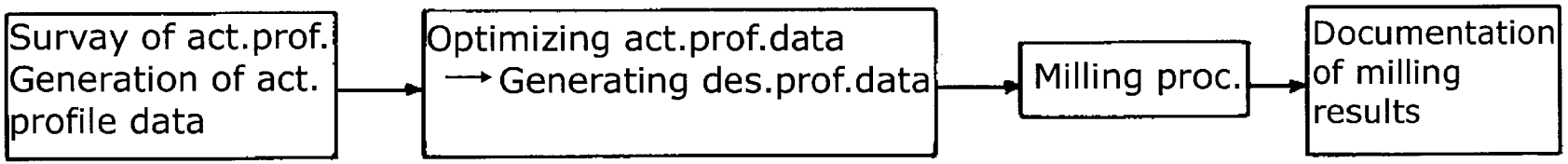
FIG. 1 shows the process of milling off traffic areas according to the invention.

The process for milling off traffic areas 2 is explained in detail in FIG. 1. Generally the process includes three process steps, i.e. first actual profile surveying with generation of the actual profile data, then preparation of a desired profile and last the milling process. Following the milling process a new actual profile survey to document the milling results can be performed.

The actual profile survey may take place in advance with a profile tracing means 8 travelling over the traffic area 2 which is to be processed later thus producing an at least two-dimensional actual profile of the traffic area 2. Employment of an absolute position determining means 16*a*, 16*c* is appropriate which helps to produce the actual profile with a high accuracy. The profile tracing means 8 is provided with a relative depth measuring means so that the depth values (z-coordinate) of the absolute position determining means 16*a*, 16*b* can be corrected by the relative depth values of the profile tracing means 8. Thus at least two-dimensional actual profile data are produced by assignment of the measured depth values to position data of the relative or absolute position determining means 16*a*, 16*b*.

Prior to the beginning of the milling process desired profile data are generated on the basis of the existing actual profile data either mathematically/geometrically by calculation or graphically on the screen offering the possibility of intervention by an operator, if necessary, with the desired profile data depending on the one hand on a predetermined milling depth and on the other hand on the depth correction values with regard to the longitudinal waviness of the traffic area 2. Thus the actual profile data are smoothed in terms of the depth values whereby a long-wave longitudinal waviness of the traffic area 2 is capable of being corrected, too. In this connection the generated desired profile data may be smoothed by calculation alone or monitored with an operator deciding, i. e. at the beginning of the downgrades, on a correction of the depth value.

The milling process comprises first the determination of the current position of the milling machine with regard to the path coordinate. This is effected, for example, using a position determining means 16*b* which is arranged on the machine frame 12 of the milling machine 6.

The position of the milling machine 6 can generally be determined by three methods:

a) In the case of absolute position determination the machine coordinates in all three space coordinates (x, y, z) are measured in absolute terms. This can be effected, for example, by means of an assisted GPS system or laser tracking stations with automatic target tracking (total stations).

In the case of the GPS system, position determination is performed with the aid of satellites with the travelling time differences of signals travelling between the satellites at different positions and the object being used for position determination. Higher accuracies are attained by the DGPS system (differential GPS) where a stationary GPS receiver 16*c* is positioned in the vicinity in addition to the GPS receiver 16*b* moving with the milling machine 6. Higher accuracy is attained by determining the signal difference of the two GPS receivers. To achieve even higher accuracies the position information can additionally be corrected by means of gyro compass, path pulse and steering information (assisted DGPS system).

b) When using one or more automatic total stations, the machine is provided with a reflector, i. e. an active or passive prism, which reflects the laser beam emitted by a transmitter/receiver unit back to the machine. The position of the machine can then be calculated from the travelling time and/or the phase position of the signal and the receiving angles.

c) Distance information is added to the actual profile data. The determined position of the milling machine 6 can then be assigned to the actual or desired profile data exclusively on the basis of the distance covered.

To further increase the accuracy the relative height coordinate between the travelling mechanisms of a milling machine 6 or a profile tracing means 8 can additionally be measured with this relative z-value being used to correct the absolute z-coordinate.

It is thus not absolutely necessary that the position determining means 16*b* of the milling machine 6 generates absolute position data.

With the aid of the position determining means 16*b* the machine control unit 10 can directly control the milling depth of the milling roller 4 as a function of the current position data of the milling machine 6 and the difference between the actual value and the desired value for the milling depth resulting from the desired profile data.

Figure 2:
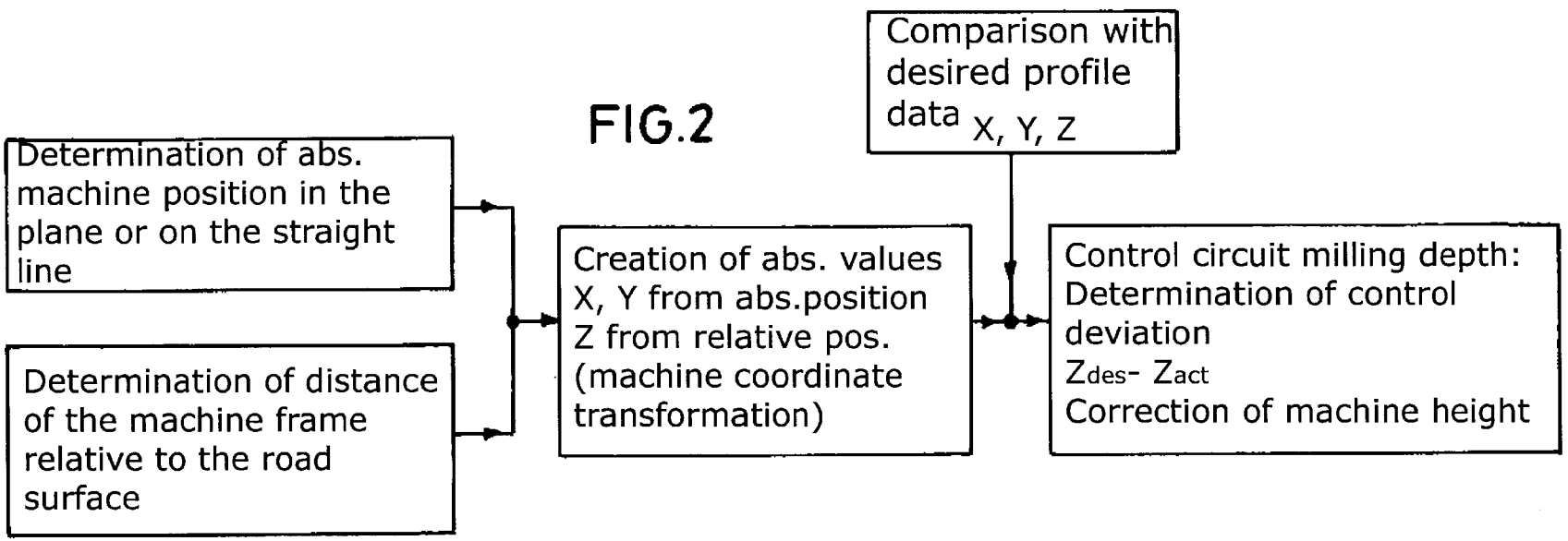
FIG. 2 shows the control of the milling depth during the milling process.

FIG. 2 explains the determination of the reference variable z-desired for the milling depth control circuit. For this purpose first the absolute machine position in the plane or in a straight line is determined by means of position determining means 16*b*. At the same time the currently adjusted milling depth z-actual is established as relative distance value between the machine frame 12 and the milled-off traffic area 3 so that the current position data with the current milling depth actual value are available. By comparison with the desired profile data the desired value z-desired for the milling depth can be determined from the desired profile data as a function of the machine position. The difference of the value z-desired minus z-actual constitutes the control deviation by which a height adjustment signal for the travelling mechanisms 14, 15 is generated which induces control of the actual value of the milling depth.

Figure 3:
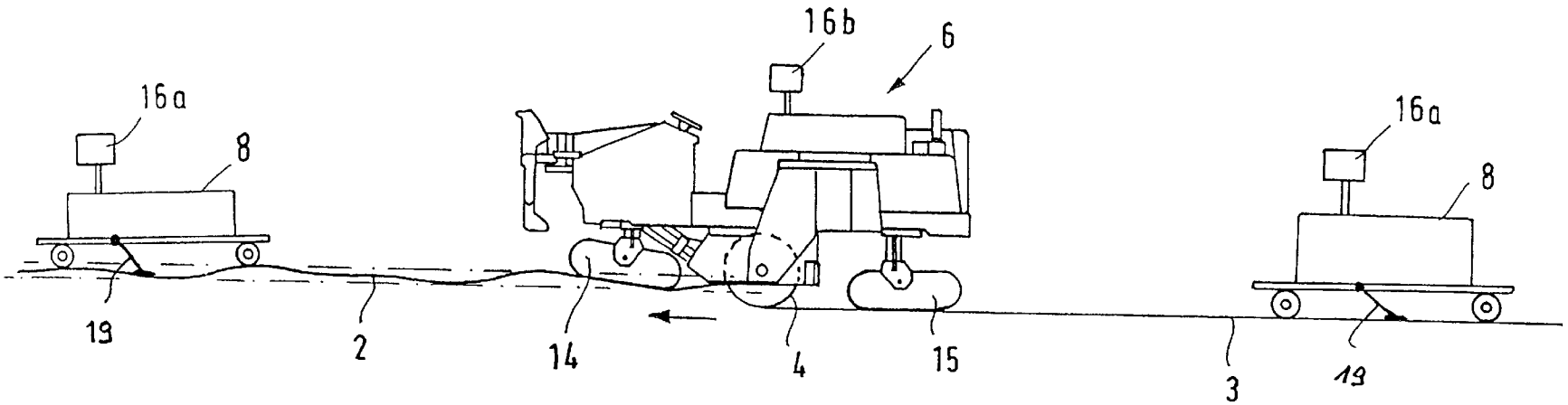
FIG. 3 shows the levelling out of the longitudinal waviness of the traffic area applying the milling process of the invention.

FIG. 3 shows the milling machine 6 whose front travelling mechanism rests upon the unprocessed traffic area 2 while the rear travelling mechanism 15 rests upon the processed traffic area 3. Of course, the two travelling mechanisms 14, 15 can be adjusted for the purpose of milling depth setting of the milling roller 4 whereas it involves more efforts to adjust the height of the milling roller 4 proper.

As can be seen from FIG. 3 the old traffic area 2 presents considerable longitudinal waviness which can be eliminated by milling depth control via the machine control unit 10. The traffic area 3 can be milled off with an accuracy in the millimeter range.

To generate the actual profile data the profile tracing means 8 drives ahead of the milling machine 6 over the traffic area 2 to be processed. The same profile tracing means 8 can, as shown on the right-hand side of FIG. 3, cross the milled-off traffic area 3 to allow another actual profile data acquisition for documentation purposes.

Figure 4:
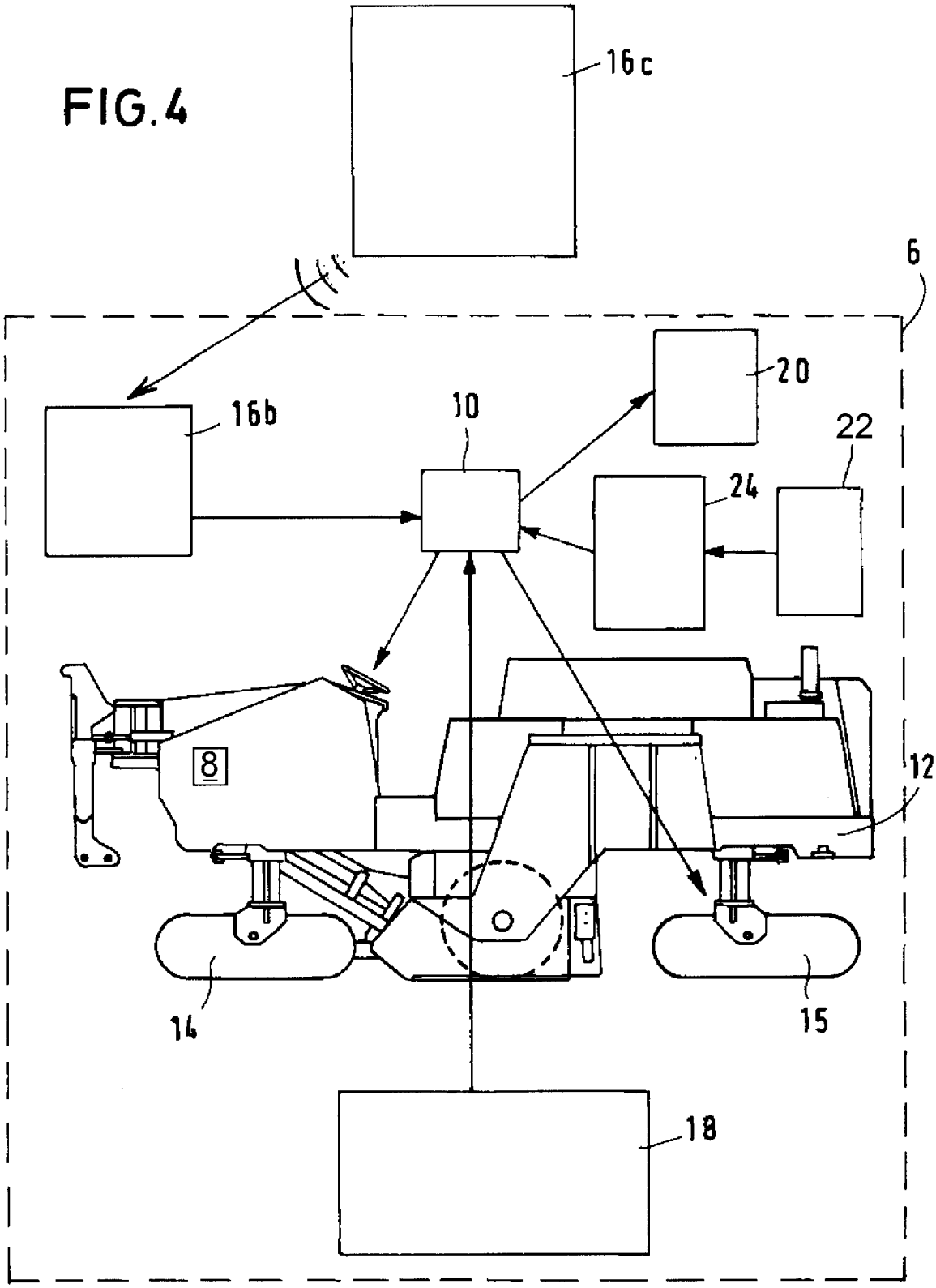
FIG. 4 shows a schematic representation of the device of the invention for milling off traffic areas.

FIG. 4 shows the milling machine with an absolute position determining means 16*b*, 16*c* (differential GPS).

This means comprises a stationary global positioning system (GPS) 16*c* which is installed at a suitable location beside the traffic area 2 to be processed and is also required for the profile tracing means 8.

The milling machine 6 comprises another GPS system 16*b* arranged on the machine frame 12.

The actual position of the milling machine 6 or the profile tracing means 8 can be determined as absolute values in x, y and z-coordinates from the difference between the data of the stationary GPS system 16*c* and those of the mobile GPS system 16*b*. The measured values of the position determining means 16*b*, 16*c* are fed to the machine control unit 10 and can be displayed by a monitor 20.

For example,the desired profile data are, as shown in FIG. 4, externally generated in a computer 22 and then fed to the machine control unit 10 via a data carrier reader 24.

Alternatively, it may be provided to transmit the desired profile data by radio to the machine control unit 10.

Another possibility is to generate the desired profile data with the aid of a computer of the machine control unit 10.

What is claimed is:

1. A process of milling-off traffic areas using a milling roller of a milling machine comprising the steps of surveying the actual profile of a traffic area and generating at least two-dimensional actual profile data by assigning the measured profile values to determine relative or absolute position data, generating desired profile data from an initial basic data set on the basis of previously or on-line determined actual profile data with the desired profile data of the traffic area being corrected in values of longitudinal waviness and with the basic data set containing the actual profile data of a section of the traffic area whose length exceeds that of the largest longitudinal wave of the traffic area to be leveled out, determining the current position of the milling machine and the current milling depth as an actual value, and controlling the milling depth of the milling cutter as a function of the difference between the actual value and the desired value from the desired profile data including the section of the traffic area whose length exceeds that of the largest longitudinal wave of the traffic area which is assigned to the current position of the milling machine.

2. The process as defined in claim 1 including the step of controlling at least one of the steering process and the transverse inclination of the milling machine as a function of the desired profile data and the current position of the milling machine.

3. The process as defined in claim 2 wherein the first section of the traffic area is surveyed absent the performance of the controlled milling step.

4. The process as defined in claim 1 including the step of measuring the actual profile of the traffic area on-line by profile tracing in advance of milling machine travel.

5. The process as defined in claim 1 including the step of measuring the actual profile of the milled traffic area together with the associated position data, and storing the latter information for documentation purposes.

6. The process as defined in claim 1 including the step of determining the position of at least one of a profile tracing means and the milling machine in three-dimensional absolute or relative values.

7. The process as defined in claim 1 including the step of determining the position of the milling machine in x and y planes in absolute values and determining the position of the milling machine in the z plane in relative values.

8. The process as defined in claim 1 including the step of determining the position of the milling machine direction in the x plane and the vertical position in the z plane in relative values.

9. The process as defined in claim 1 including the step of determining the position of the milling machine three-dimensionally in absolute values.

10. The process as defined in claim 1 including the step of determining the position of the milling machine three-dimensionally in relative values.

11. The process as defined in claim 1 wherein the surveying step of the actual profile is performed by travelling over a first section of the traffic area, the step of generating the desired profile data includes utilizing the actual profile data of the first section of the traffic area, milling off the first section of the traffic area utilizing a milling depth control based upon the desired profile data of the first section derived from the initial basic data set, continuously updating the basic data set relating to a predetermined basic length of the traffic area after milling off the first section by incrementally updating the actual profile data, and milling off further sections of the traffic area dependent upon continuous updated desired profile data and continuously updated basic data set.

12. The process as defined in claim 11 wherein the basic data set contains the actual profile data of a section of the traffic area of substantially 50 to 300 m.

13. The process as defined in claim 11 wherein the basic data set contains the actual profile data of a section of the traffic area of substantially 100 to 200 m.

14. The process as defined in claim 11 including the step of separately profile tracing the actual profile of the first section of the traffic area.

15. The process as defined in claim 14 wherein the profile tracing step is performed in advance of the movement of the milling machine.

16. The process as defined in claim 14 wherein the profile tracing step is performed at a preselected distance forward of the advancement of the milling machine to generate profiled data based upon traffic areas milled and to be milled.

17. A device for milling off traffic areas comprising a machine frame having a predetermined length in the direction of travel, a height-adjustable self-propelled running gear, a milling roller supported on the machine frame, a machine control unit, a drive unit for the running gear and the milling roller, computer means for generating desired profile data corrected in terms of longitudinal waviness of the traffic area on the basis of predetermined actual profile data of the traffic area which is transmitted to the machine control unit, position determining means for determining the current position data of the machine frame, milling depth measuring means for measuring milling depth as an actual value, profile data generating means for generating the desired profile data equalized in terms of short-wave and long-wave depth deviations on the basis of a basic data set containing the actual profile data of a section of the traffic area whose length exceeds that of the largest longitudinal wave to be equalized, and said machine control unit includes means for controlling the milling depth of the milling roller in dependence upon the actual position data of the machine frame and the difference between the actual value and the desired value from the desired profile data which is assigned to the position of the machine frame.

18. The device as defined in claim 17 including profile tracing means for generating three-dimensional predetermined actual profile data of the traffic area.

19. The device as defined in claim 18 including position determining means which includes a first GPS receiver carried by the machine frame, a secondary GPS receiver in the vicinity of the traffic area, and a computer for determining the current position of one of the profile tracing means and the machine frame three-dimensionally in absolute values.

20. The device as defined in claim 18 including position determining means which includes first and second GPS receiver means in the vicinity of the traffic area for generating a position signal, and a computer for determining the current position of one of the profile tracing means and the machine frame three-dimensionally in absolute values.

21. The device as defined in claim 17 including profile tracing means separate from and arranged in front of the machine frame as viewed in the direction of travel for generating a three-dimensional predetermined actual profile of the traffic area and transmits the actual profile data on-line to the machine control unit.

22. The device as defined in claim 17 including position determining means which includes one transmitting station and one receiving station.

23. The device as defined in claim 17 wherein the machine control unit generates steering control signals as a function of the current position data.

24. The device as defined in claim 17 wherein the machine control unit controls the transverse inclination of the machine frame as a function of the desired profile data and current position data.

* * * * *